United States Patent [19]

Kornbrekke et al.

[11] Patent Number: 4,698,937

[45] **Date of Patent: * Oct. 13, 1987**

[54] TRAFFIC RESPONSIVE CONTROL SYSTEM FOR AUTOMATIC SWINGING DOOR

[75] Inventors: Henning N. Kornbrekke, Burlington; David M. Cirkot, Ansonia; Anthony R. Ranaudo, Naugatuck, all of Conn.

[73] Assignee: The Stanley Works, New Britain, Conn.

[ * ] Notice: The portion of the term of this patent subsequent to Jan. 21, 2003 has been disclaimed.

[21] Appl. No.: 587,407

[22] Filed: Mar. 8, 1984

Related U.S. Application Data

[63] Continuation-in-part of Ser. No. 555,565, Nov. 28, 1983.

[51] Int. Cl.[4] ..... E05F 15/20

[52] U.S. Cl. ..... 49/25; 49/31; 250/221; 340/545

[58] Field of Search ..... 49/25, 28, 30, 31, 264; 340/545, 546, 696, 825.72; 250/221, 222.1

[56] References Cited

U.S. PATENT DOCUMENTS

| | | | |
|---|---|---|---|
| 3,852,592 | 12/1974 | Scoville et al. | 250/221 |
| 3,857,466 | 12/1974 | Berkovitz et al. | 250/221 X |
| 4,272,921 | 6/1981 | Jorgensen | 49/31 X |
| 4,514,625 | 4/1985 | Heiland | 340/556 X |
| 4,560,912 | 12/1985 | Jonsson | 49/25 X |
| 4,565,029 | 1/1986 | Kornbrekke et al. | 49/25 |

OTHER PUBLICATIONS

Installation Manual, US-021, Vision Pulse, pp. 0984 through 1005.

Multiscan Installation Instructions and Service Guide, Jan., 1974, pp. 1063 throgh 1080.

Multiscan Hook-up and Service, Aug., 1977, pp. 1103 through 1115.

*Primary Examiner*—Kenneth Downey

*Attorney, Agent, or Firm*—Prutzman, Kalb, Chilton & Alix

[57] ABSTRACT

An automatic door installation with two traffic sensors mounted on each side of the door adjacent the opposite side edges thereof, each having a reflected energy receiver and a plurality of radiant energy emitters with angularly spaced beam axes to provide broad coverage areas intersecting the traffic path of travel. The emitters of each sensor are selectively activated at different radiant energy levels and/or selectively deactivated to vary the affective coverage area as the door is swung between its closed and open positions.

26 Claims, 12 Drawing Figures

TRAFFIC RESPONSIVE CONTROL SYSTEM FOR AUTOMATIC SWINGING DOOR

This application is a continuation-in-part of our copending patent application field Nov. 28, 1983, assigned Ser. No. 555,565 and entitled "Traffic Responsive Control System For Automatic Swinging Door".

BRIEF SUMMARY OF THE INVENTION

The present invention relates generally to traffic responsive control systems for automatic swinging doors and relates more particularly to a new and improved traffic responsive control system for sensing traffic approaching the door and operable for opening the door away from the approaching traffic, holding the door open until the traffic passes completely free of the door and controlling the operation of the door to prevent abrupt engagement of the door with traffic in or adjacent to the path of travel of the door.

It is a primary aim of the present invention to provide a new and improved traffic responsive control system of the type described having a traffic sensor system for sensing the presence of traffic at both the entrance and exit sides of the swinging door and which provides for automatically opening the door when there is traffic at the entrance side of the door and when there is no traffic within or adjacent to the opening path of travel of the swinging door.

It is another aim of the present invention to provide a new and improved traffic sensor system for an automatic swinging door which employs infrared energy transmission and reflected infrared energy receiving for sensing the presence of traffic at the entrance or non-swing side of the door and/or within or adjacent to the opening path of travel of the swinging door at the exit or swing side of the door. In accordance with the present invention, a traffic sensor system is provided which employs commercially available, infrared, light emitting diode (LED) emitters and photodiode receivers and which continually provides the desired coverage area as the door swings between its closed and open positions.

It is a further aim of the present invention to provide a new and improved sensor system for an automatic swinging door which is mounted on the back or swing side of the door and which is operable for sensing any traffic or object within or adjacent to the opening path of travel of the swinging door.

It is another aim of the present invention to provide a new and improved sensor system for an automatic swinging door which is mounted on the front or non-swing side of the door and which is operable for sensing the presence of traffic as the traffic approaches the closed door, passes through the doorway opening and until the traffic is completely free of the closing path of travel of the open door.

It is a further aim of the present invention to provide a new and improved traffic sensor system for the entrance or non-swing side and/or exit or swing side of an automatic swinging door which is mounted on the door and which avoids sensing the door frame and any other structure, traffic or object at either side of the traffic path of travel through the doorway opening as the door swings between its closed and open positions.

A better understanding of the invention will be obtained from the following detailed description and the accompanying drawings of an illustrative application of the invention.

DESCRIPTION OF THE PREFERRED EMBODIMENT

Figure 9:
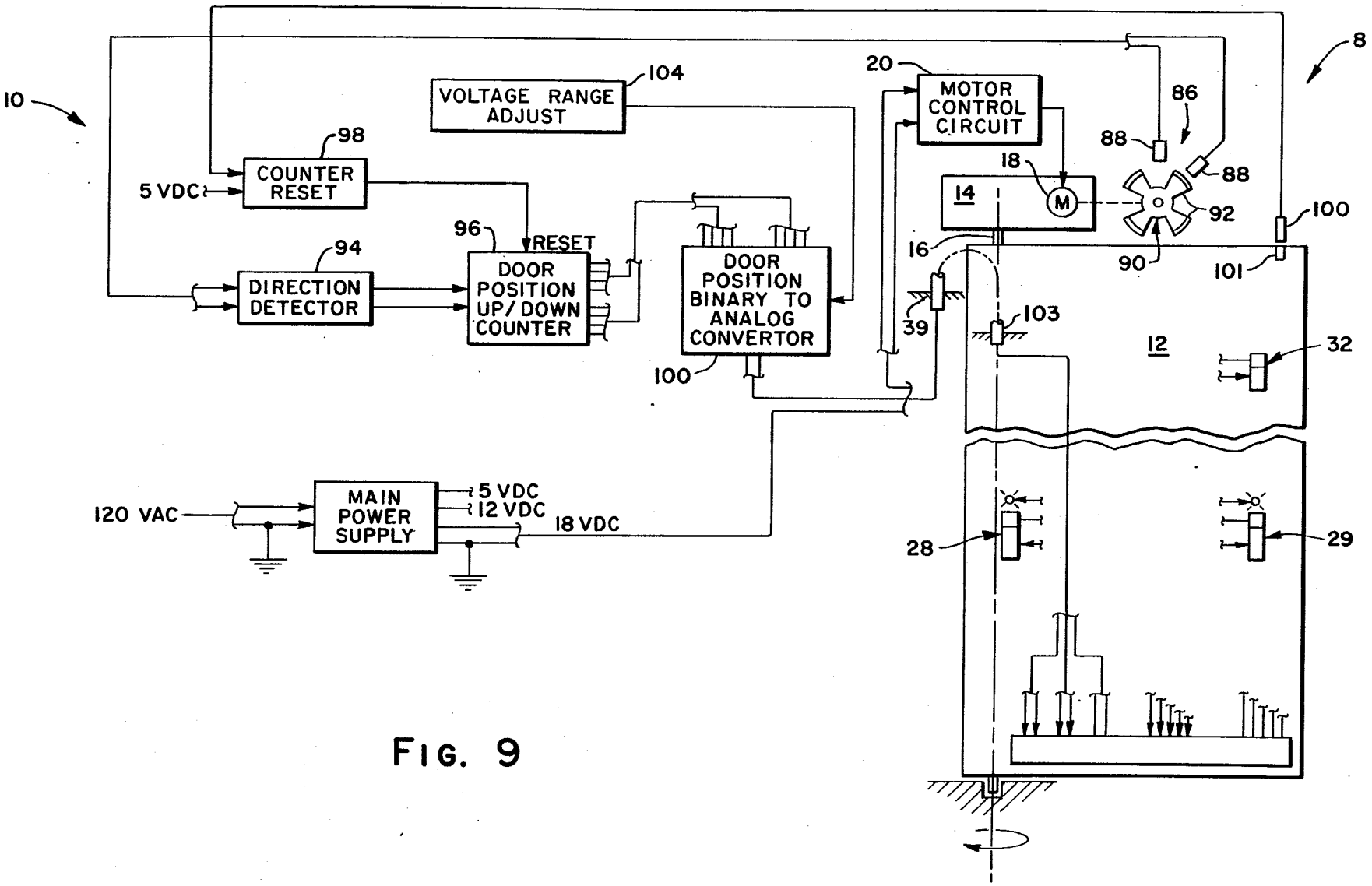
FIG. 9 is a diagrammatic illustration, partly broken away, of the automatic door installation, including a functional block diagram of a header mounted electronic circuit of the traffic responsive control system.

Referring now to the drawings in detail wherein like numerals designate the same or similar parts, an automatic door operator installation 8 incorporating an embodiment 10 of a traffic responsive control system of the present invention is shown employed with a pivotal or swinging door 12 having an overhead or header mounted power operator 14. Referring to FIG. 9, the power operator 14 is shown directly connected to the door 12 via a vertical pivot or drive shaft 16 of the power operator 14. Except as described otherwise herein, the power operator 14 may for example be identical to the power operator disclosed in U.S. Pat. No. 4,220,051 of John C. Catlett, dated Sept. 2, 1980 and entitled "Electromechanical Door Operator" and therefore U.S. Pat. No. 4,220,051 is incorporated herein by reference. The power operator 14 has a suitable electric motor 18 for opening the door 12, 90 degrees in the clockwise direction as viewed in FIG. 2 from its closed position shown in FIG. 2. Also, the motor 18 is held energized, preferably at a lower power level than required for opening the door 12, to hold the door 12 in its fully open position. As described in detail in U.S. Pat. No. 4,220,051, a spring operated mechanism (not shown) is employed for pivoting the door 12 to its closed position and the motor 18 is employed to brake the rate at which the door is closed.

A suitable motor control circuit 20 controls the operation of the motor 18, and thereby controls the opening and closing movement of the door 12, in response to "Operate" and "Safety" signals received from the traffic responsive control system 10. Briefly, an "Operate" signal is generated by the control system 10 to open the door as a pedestrian or other traffic approaches the entrance or non-swing side of the door. The "Operate"

nal continues to be generated by the control system 10 as the pedestrian, etc. passes across the door threshold and through the doorway opening and until after the pedestrian, etc. is completely clear of the closing path of travel of the open door 12. Thus, the "Operate" signal provides for both opening the door and for holding the door open until the pedestrian, etc. is clear. A slight display of for example one-half second is then provided before the power operator 14 is operated to close the door.

In addition, as the door is closed, an "Operate" signal is generated by the control system 10 either to reopen or stall the partly closed door if a pedestrian or other traffic approaches the entrance side of the door or is sensed within an adjacent to the closing path of travel of the door. More specifically, the motor control system 20 will then reopen the partly closed door unless an object is also sensed within or adjacent to the opening path of travel of the door, in which event, the control system 20 will hold or stall the door at its partly closed position until the traffic, etc., clears either side of the door.

A "Safety" signal is generated by the control system 10 when a pedestrian or other traffic or object is sensed within a safety area on the exit side of the door when the door is closed. In that case, the "Safety" signal in effect overrides an "Operate" signal to prevent the door 12 from opening. In addition, as the door 12 is opened, a "Safety" signal is generated by the traffic responsive control system 10 when a pedestrian or other traffic or object is sensed within or adjacent to the opening path of travel of the door 12. In that case, the motor control system 20 is then operated by the "Safety" signal to close the partly open door 12 or, if traffic, etc., is also sensed on the entrance side of the door, to hold or stall the door at its partly open position until the traffic, etc., clears either side of the door.

Thus, the "Operate" and "Safety" signals generated by the traffic responsive control system are employed to control the operation of the door to provide for fully opening and closing the door in the same way as the "Operate" and "Safety" signals generated by prior conventional mat switches (not shown) provided on the entrance and exit sides of the doorway opening. In addition, the "Operate" and "Safety" signals provide for stalling a partly opened or partly closed door while traffic or an object is sensed on both sides of the door.

The traffic responsive control system 10 comprises four separate primary presence sensors 28–31 mounted on the door 12 and a secondary presence sensor 32 mounted on the door 12 directly above one of the primary sensors. When the door is closed, each of the four primary presence sensors 28–31 is positioned to cover a specific control area spanning the path of travel of traffic passing through the doorway opening. Two primary sensors are mounted on each side of the door to collectively cover approximately the same horizontal area as conventional entrance and exit mat switches (not shown), in general a rectangular area extending up to four to six feet in each direction from the doorway opening and having a width about five inches greater in each direction than the doorway opening. Each of the four primary sensors 28–31 comprises seven LED infrared emitters or transmitters 34, three photodiode receivers 36 for receiving infrared energy transmitted by those transmitters 34 and reflected from a pedestrian or other traffic or object within the coverage zone of the sensor, and an LED indicator light 38 provided to indicate that the sensor has sensed the presence of any object or traffic in its coverage zone.

The secondary presence sensor 32 is positioned on the back or swing side of the door 12 adjacent the leading or free edge of the door 12 to provide a relatively high coverage zone immediately above the exit rail 68 on the left side of the traffic path of travel through the doorway opening (and is referred to herein as the "rail" or "rail safety" sensor or by the letters "RS"). The rail sensor 32 comprises in the shown embodiment only one LED infrared emitter or transmitter 34 and one receiver 36. The rail sensor 32 does not employ a separate indicator light 38 and instead, the indicator light 38 of the primary sensor 29 mounted directly below the rail sensor 32 is also operated when the rail sensor 32 senses an object or traffic within its coverage zone. If desired, the disclosed system may be readily modified to employ up to three additional emitters 34 (and additional receivers 36) to expand the coverage zone of the rail sensor 32.

The four primary sensors 28–31 comprise two primary exit or safety side sensors 28, 29, mounted on the back or swing side of the door 12 and which, when the door is closed, cover the safety or exit area on the swing side of the doorway opening. One of those safety side sensors 28 is mounted on the door adjacent the pivot edge of the door 12 (and is referred to herein as the "pivot safety" sensor or by the letters "PS") and the other primary safety side sensor 29 is mounted on the door 12 adjacent the leading or free edge of the door 12 (and is referred to herein as the "leading edge safety" sensor or by the letters "LES"). Similarly, the remaining two primary sensors 30, 31 are mounted on the front or entrance side of the door 12 adjacent the pivot and leading edges respectively of the door (and are referred to herein as the "pivot operate" sensor or by the letters "PO" and as the "leading edge operate" sensor or by the letters "LEO"). Of the four primary sensors 28–31, the LES and PO sensors 29, 30 are identical, and the PS and LEO sensors 28, 31 are identical, and the two pairs of identical sensors 29, 30 and 28, 31 are mirror duplicates.

Each of the five sensors 28–32 has a suitable relatively broad band filter 46, 48 for the respective sensor receiver(s) 36 to block out most of the ambient radiant energy which might otherwise be received by the receiver(s) 36.

Figure 2:
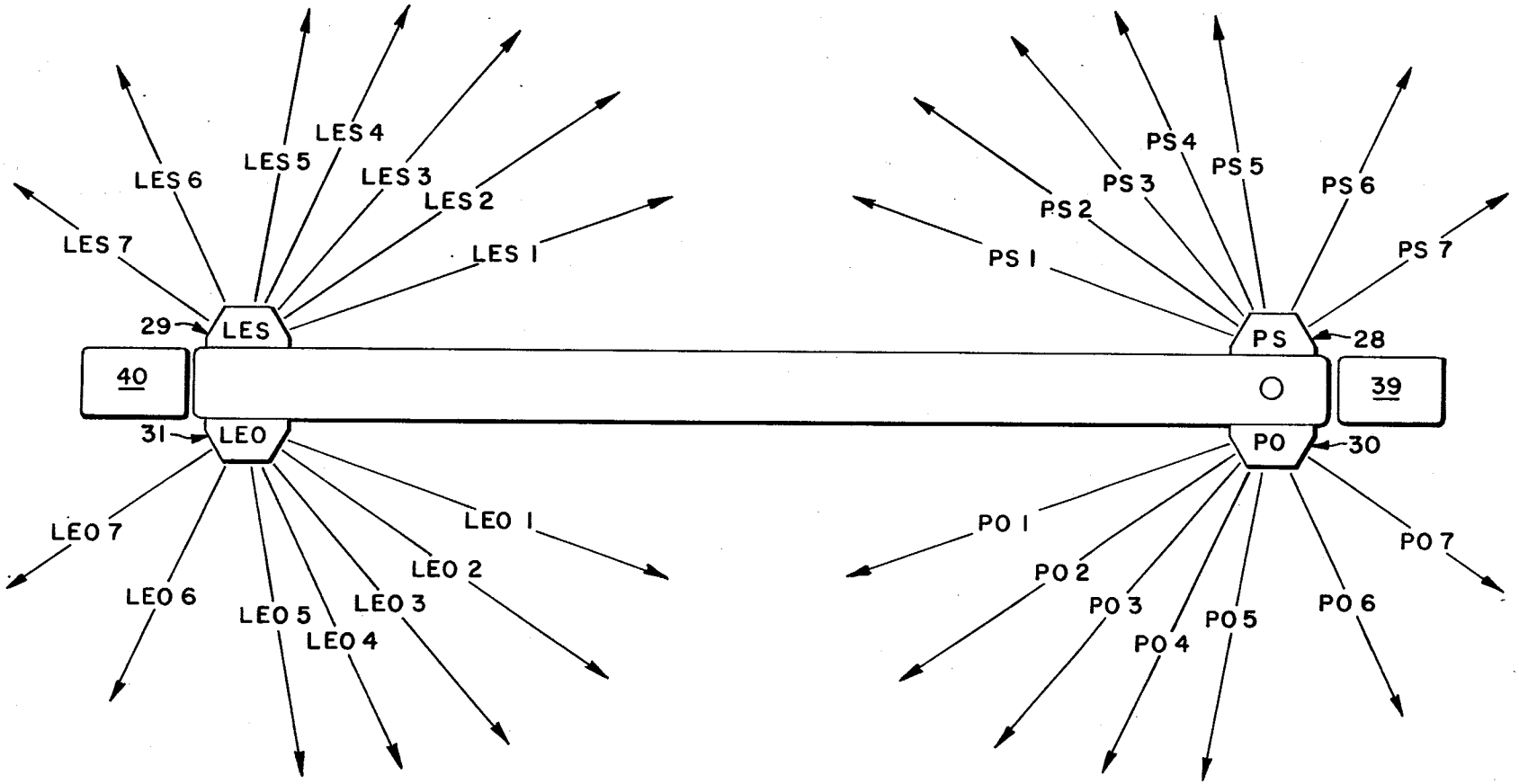
FIG. 2 is a generally diagrammatic top plan view of the door installation showing the beam axes of the infrared energy emitters of four primary presence sensors of the traffic responsive control system.
Figure 3:
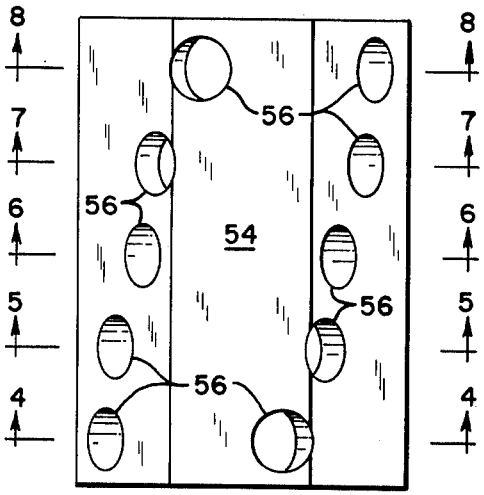
FIG. 3 is an enlarged front elevation view of an emitter mounting block of a primary sensor.
Figure 4:
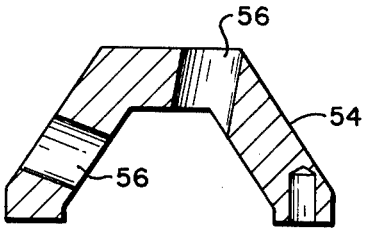
FIGS. 4–8 are section views, partly in section, of the emitter mounting block, taken along 10 degree downwardly inclined parallel planes generally identified by the lines 4—4, 5—5, 6—6, 7—7 and 8—8 in FIG. 3, and additionally showing in FIG. 5 an emitter mounted on the block.
Figure 5:
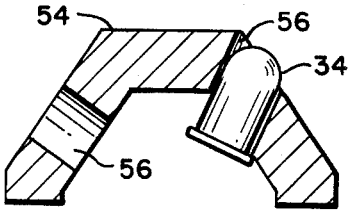
Figure 6:
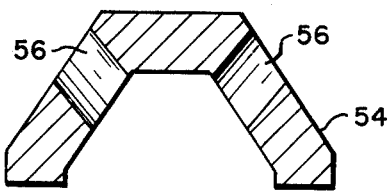
Figure 7:
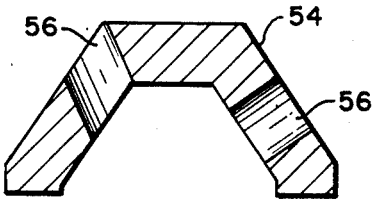
Figure 8:
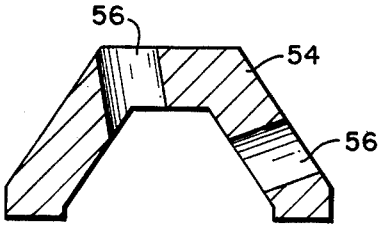
Figure 11:
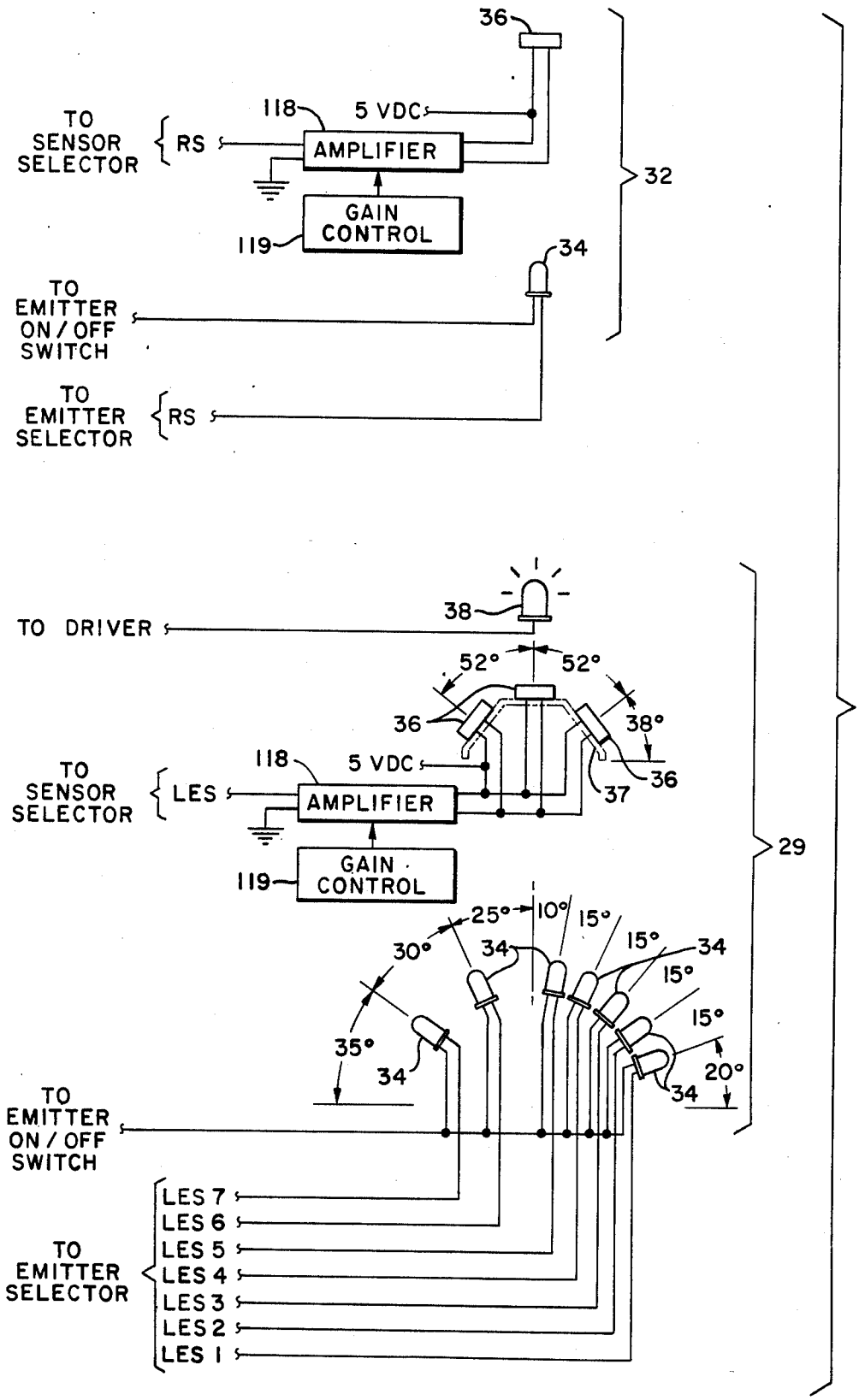
FIG. 11 is a schematic diagram, partly broken away, of rail and leading edge safety sensors of the traffic responsive control system.

Referring to FIGS. 2 and 11, each LED transmitter 34 emits a beam of radiant infrared energy (e.g. having a wavelength of 880 nanometers in the near infrared band) which has a divergence cone which is approximately 20 degrees in the case of each LED transmitter 34 of the four primary sensors 28–31, and which has a divergence cone of approximately 40 degrees in the case of the transmitter 34 of the rail sensor 32. The axis or centerline of each LED transmitter beam of each primary sensor is illustrated in FIG. 2, and as shown, each of the four primary sensors 28–31 has seven transmitters 34 forming a set of five generally inwardly facing transmitters 34 and a set of two generally outwardly facing transmitters 34. The set of five generally inwardly facing transmitters 34 have beam axes spaced 15 degrees apart (starting 20 degrees from the plane of the door) and so that the 20 degree beam coverage areas of adjacent beams overlap slightly. The beam axes of the set of two generally outwardly facing transmitters 34 are spaced 30 degrees apart and are spaced respectively 35 and 65 degrees from the plane of the door.

Each primary sensor 28–31 has a bank of three infrared receivers 36 (FIG. 11) mounted on a truncated support frame 37 directly above the corresponding bank of transmitters 34 to provide a wide, unfocused, approximately 180 degree field of view to receive reflected infrared energy from the entire coverage zone of the corresponding bank of transmitters 34.

As is explained more fully hereinafter, the twenty-nine transmitters 34 of the five sensors 28–32 are connected to be pulsed or energized in sequence and the receiver systems of the four primary sensors 28–31 are connected to be individually activated while a transmitter 34 of the corresponding sensor 28–31 is being pulsed. In addition, the receiver systems of the rail sensor 32 and LES sensor 29 are activated together while a transmitter of either of those sensors 29, 32 is being pulsed. Also, as hereinafter described, the transmitter pulse frequency is modulated to encode the entire sensor system and such that for example the sensor systems used with adjacent or nearby automatic doors can be encoded differently to avoid cross interference.

The set of five generally inwardly facing transmitters 34 of each of the primary sensors 28–31 provides a horizontal angle of coverage of approximately 80 degrees extending from an angle of approximately 10 degrees from the plane of the door 12 to approximately a plane perpendicular thereto. With the door 12 closed, the sensor coverage zone of each set of five generally inwardly facing transmitters 34 of each of the two entrance sensors 30,31 spans the entrance path of travel leading to the door 12 and will sense the presence of a pedestrian or other traffic or object anywhere within a generally rectangular entrance area. Similarly, with the door 12 closed, the sensor coverage zone of each set of five generally inwardly facing transmitters 34 of each of the two safety sensors 28, 29 spans the exit path of travel leading from the door 12 and will sense the presence of a pedestrian or other traffic or object anywhere within a generally rectangular exit area. The rail sensor 32 has one transmitter 34 with a beam axis extending approximately perpendicular to the plane of the door 12 and provides a horizontal coverage area of approximately 40 degrees. The rail sensor 32 is vertically positioned to be capable of sensing a child or other pedestrian leaning over the exit rail 68 into the opening path of travel of the door 12 above the coverage zone of the lower primary LES sensor 29.

The three safety sensors 28, 29, 32 cover the doorway area behind and adjacent to the opening path of travel of the door, and the two entrance sensors 30, 31 cover the doorway area in front of the closed door and additionally cover the area adjacent to the closing path of travel of the door as the door 12 pivots between its fully open and fully closed positions. Thus, the three safety sensors 28, 29, 32 cover the area behind the door 12 not only when the door is fully closed but also as the door is opened and closed. The two entrance sensors 29, 30 not only cover the area in front of the door 12 when the door is fully closed but also as the door is opened and closed.

Referring to FIGS. 3–8, each of the four primary sensors 28–31 has a transmitter mounting block 54 (which is generally V-shaped in transverse section as shown in FIGS. 4–8) for establishing the transmitter beam axis orientation. For economy of manufacture, the transmitter mounting blocks 54 of the four primary sensors 28–31 are identical. A suitable single transmitter mounting block (not shown) is used for the rail sensor 32.

The mounting block 54 has ten emitter support openings or bores 56 which are relatively oriented in accordance with the described LED beam axis orientation. Also, the support bores 56 are positioned relatively close together and so that the intersections or crossing points of the transmission beam axes of each primary sensor 28–31 are relatively close together and the beams can be considered to emanate from a single point. For that purpose and because of their varying angular orientation, the transmitter support bores 56 are mounted in an array of five parallel planes as shown in FIGS. 3–8.

Figure 1:
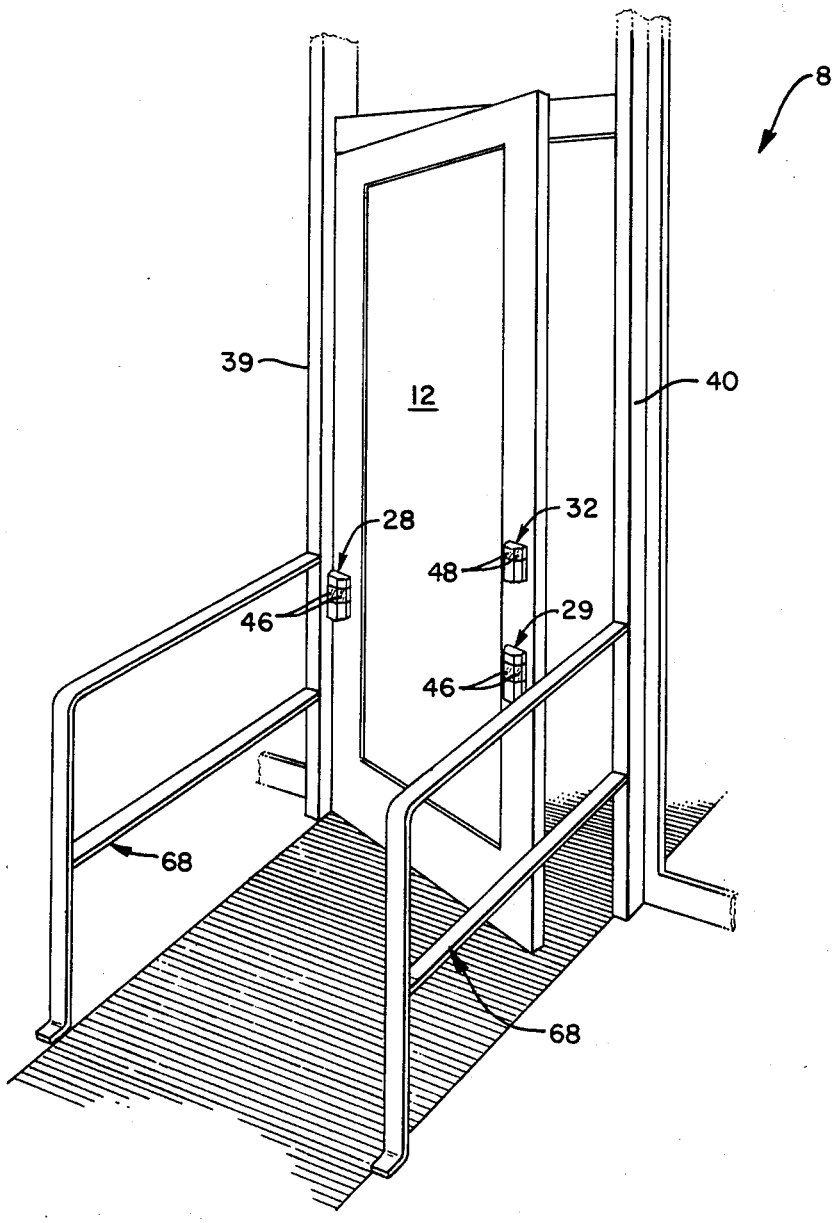
FIG. 1 is a perspective view, partly broken away, of an automatic door installation incorporating an embodiment of a traffic responsive control system of the present invention.

In order to help reduce or prevent interference by the sun and other sources of ambient infrared radiant energy and to help avoid sensing the doorjambs 39, 40 and the doorway exit rails 68 (FIG. 1), the axes of the transmitters 34 of all of the five sensors 28–32 are angled 10 degrees downwardly from the horizontal. The transmitters 34 of all four primary sensors 28–31 are mounted approximately the same distance from the floor, for example approximately twenty-four inches from the floor, depending on the installation. In that example, the vertical height of the sensor coverage zone, at its maximum, extends from approximately twelve inches from the floor to approximately twenty-four inches from the floor. Accordingly, the four primary sensors 28–31 will not sense either the floor or relatively small objects on the floor. The relatively high rail sensor 32 is mounted substantially above the primary sensors 28–31, for example approximately 6 to 12 inches above the top of the adjacent exit rail 68, in which event the vertical height of the coverage zone of the rail sensor 32, at its maximum, extends from below the top of that exit rail 68 to approximately 24 inches above that exit rail 68. Also, as hereinafter described, the sensor transmitters 34 are selectively deactivated and selectively activated at varying power levels in accordance with the pivotal position of the door 12 to avoid sensing, as the door pivots between its open and closed positions, the doorjambs 39, 40, rails 68 or any walls or other structures or objects or traffic adjacent to but on either side of the desired coverage zone of the sensor system.

Figure 10A:
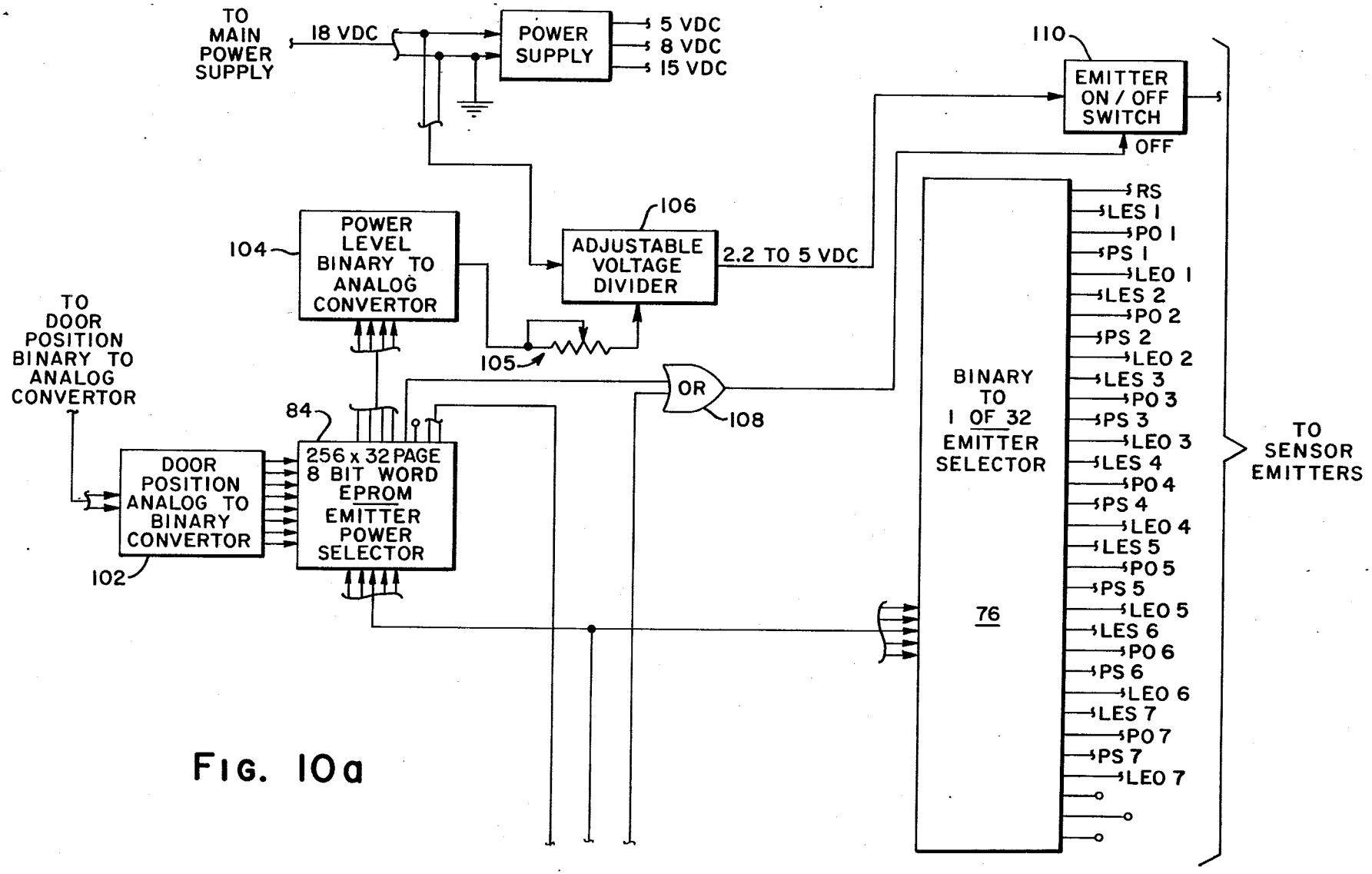
FIGS. 10A and 10B collectively provide a functional block diagram, partly broken away, of a door mounted electronic circuit of the traffic responsive control system.
Figure 10B:
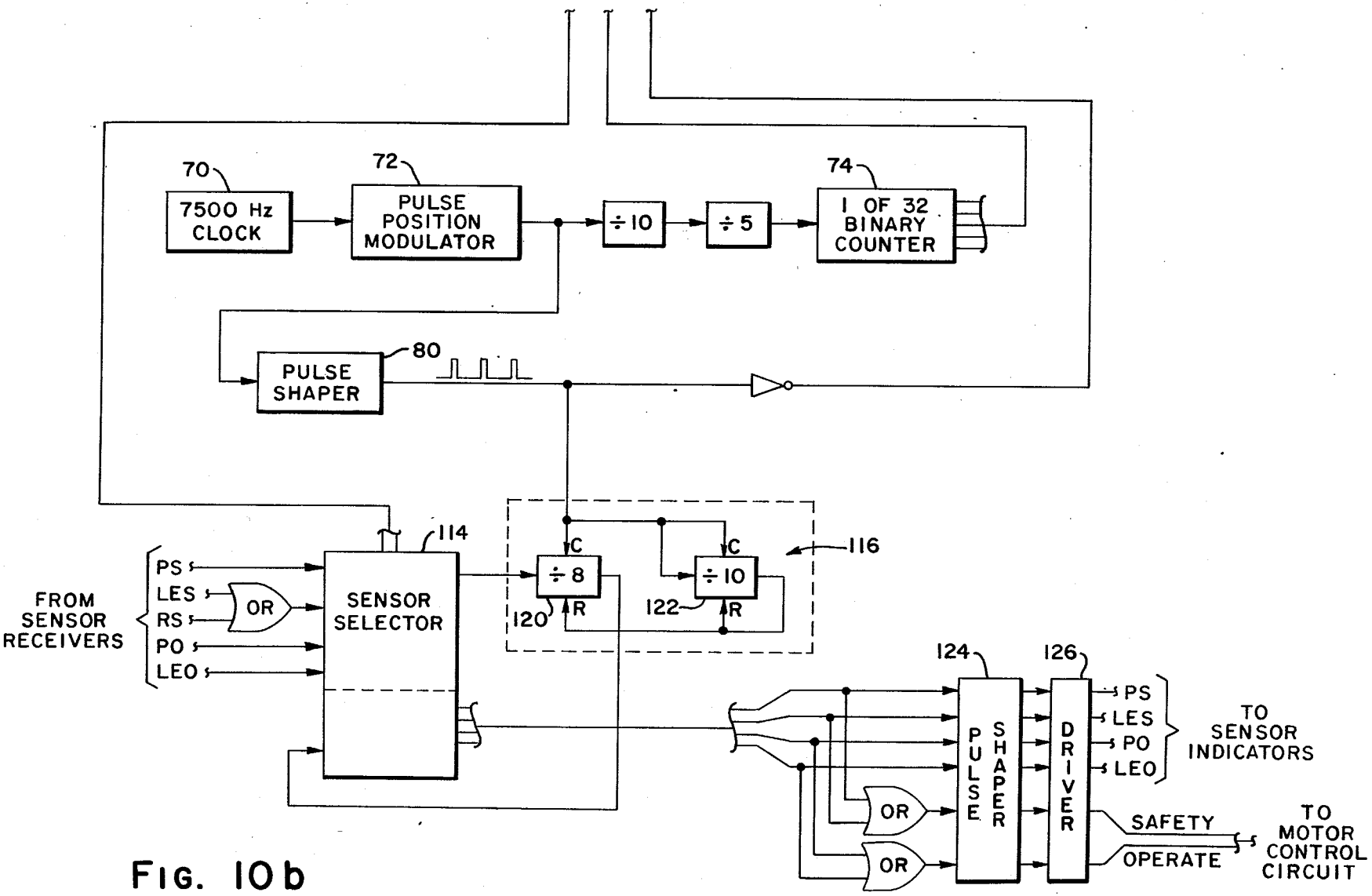

Referring to FIGS. 9 and 10A and 10B, a 7,500 Hz. oscillator or clock 70 is provided for pulsing the twenty-nine transmitters 34 in a predetermined sequence and with each transmitter being pulsed fifty times at 7500 Hz. during each pulse cycle. A suitable pulse position modulator 72 is employed for encoding the train of pulses from the 7500 Hz. clock 70. The pulse position modulator 72 provides a repeating six pulse code having a selected coded arrangement of relatively short and long intervals between the six pulses. The modulator 72 has a suitable code selector (not separately shown) which is used to select any one of thirty-two different pulse interval codes. The modulator output is connected via two successive counters to a binary counter or selector 74 to generate a repeating cycle of thirty-two successive transmitter select signals in a five bit output of the counter 74. A binary to decimal selector 76 is operated by the five bit output of the counter 74 for individually selecting each of the twenty-nine LED transmitters 34 in sequence (the remaining three outputs of the selector 76 not being used in the described embodiment). For example, the LED transmitters 34 are selected in the order shown (FIG. 10A) by the designations applied to the output leads of the selector 76 (with each sensor identified by letters and the seven emitters each primary sensor 28–31 identified by the numerals through 7 starting with the inwardly facing emitter closest to the door as shown in FIG. 2). Thus, in the sequence shown in FIG. 10, the single rail sensor transmitter (i.e. RS) is first; the No. 1 emitters of the four primary sensors 28–31 then follow in sequence; the No. 2 emitters then follow in sequence, and so on, through all seven emitters of all four primary sensors 28–31. As previously indicated, the remaining three outputs of the selector 76 are not employed in the shown embodiment, but could be used with up to three additional transmitters of the rail sensor 32. Thus, each transmitter 34 is selected for a period of approximately 1/250th of a second and as explained further hereinafter, during each such select interval the selected transmitter 34, if active, will be pulsed fifty times at a modulated frequency of 7500 Hz.

A relatively high transmitter drive voltage of up to 10 volts is used to produce the desired transmitter range of up to four to seven feet. For that reason, a pulse shape control circuit 80 is provided to establish a narrow drive pulse width of approximately fifteen microseconds for pulsing each LED transmitter 34 a corresponding short time interval and thereby to assure that the transmitters have a long useful life with the high drive voltage.

An EPROM chip 84 is provided for selectively controlling the operation of each transmitter 34—i.e. selectively deactivating each transmitter 34 and selectively activating each transmitter 34 at any one of sixteen available power levels, both in accordance with the pivotal position of the door 12. For that purpose a suitable rotary pulse generator or digital encoder 86 (FIG. 9) is provided for determining the exact pivotal position of the door 12. The encoder 86 employs a pair of angularly (67½ degree) spaced retroreflective sensors 88 and a rotor 90 driven by the power operator motor 18 having four equiangularly (90 degree) spaced axially extending reflector vanes 92, each having a circumferential width of 45 degrees. Each sensor 88 comprises an LED transmitter (not separately shown) and a phototransistor receiver (not separately shown) and generates four pulses for each 360 degrees of rotation of the rotor 90. The two sensors 88 provide two output signals in quadrature for determining the direction of rotation of the rotor (and therefore also the direction of pivotal movement of the door 12) with a suitable direction detection circuit 94. A bidirectional or up/down door position counter 96 is indexed upwardly as the door swings open (i.e. as the motor 18 rotates in one direction) and downwardly as the door swings closed (i.e. as the motor 18 rotates in the opposite direction). The count of the counter 96 therefor reflects the actual pivotal position of the door. A suitable reset circuit 98 is provided for periodically resetting the door position counter 96 to "O" to assure continuing counter accuracy. The reset circuit 98 is operated by a magnetic switch 100 mounted in the door header to be closed by a small magnet 101 mounted in the upper edge of the door 12 to reset the door position counter 96 when the door reaches its "O" or fully closed position. The reset circuit 98 also resets the counter 96 when the power to the sensor system goes on.

The memory 84 provides for selecting two hundred fifty six (256) incremental angular positions of the door between its fully closed and fully open position. The memory 84 is connected to the door position counter 96 via a binary to analog converter 100 and an analog to binary converter 102 which provides an eight bit input to the memory 84. A second input to the memory 84 is provided by the five bit output of the transmitter selector 74. The conversion of the door position signal from binary to analog and then back to binary is provided in part so that a two lead connection can be used between the first converter 100 provided in the header mounted circuit and the second converter 102 provided in the door mounted circuit (preferably provided at the bottom of the door as diagrammatically shown in FIG. 9 either within the door structure or on the back or safety side of the door 12). In addition, a voltage range adjustment circuit 104 is provided in the header mounted circuit to adjust the output voltage range of the converter 100 to a predetermined voltage range of 0 to 5 volts for establishing the 256 binary coded incremental positions of the door 12 during its full 90 degree angle of travel between its fully closed and fully open positions. In that regard, the count of the door position counter 96 at each incremental door position will be dependent on whether the power operator 14 is header mounted as shown in FIG. 9 or surface mounted (not shown), and if surface mounted, the direction the door opens in relationship to the surface mounted operator 14. For example, if the power operator 14 is header mounted as shown in FIG. 9, the power operator drive motor 18 will typically rotate approximately 39 revolutions for a full 90 degree swing of the door. If the power operator 14 is surface mounted, the motor 18 will typically rotate either approximately 61 revolutions or 30 revolutions, depending on the opening direction of the door relative to the power operator 14, for a full 90 degree swing of the door. Accordingly, the door position count of the up/down position counter 96 will vary considerably with the door installation. The voltage range adjustment circuit 104 is provided for calibrating each door installation to provide the same analog output voltage range for a full 90 degree swing of the door 12. The second converter 102 then reconverts the analog voltage output of the first converter 100 to a binary output representing one of 256 incremental positions of the door 12.

In lieu of providing an encoder 86 driven by the power operator motor 18, a suitable potentiometer (not shown) or other rotary encoder (not shown) could be mounted for example on the back or swing side of the door 12 adjacent the pivot edge of the door 12 and connected to the adjacent doorjamb 39 to be rotated to generate a signal for determining the door position. If a rotary potentiometer or other analog encoder is used, the door position counter 96 and converter 100 would not be necessary and the analog output signal of the rotary encoder could be necessary to provide an input analog signal to the analog to binary converter 102. Also, if the rotary encoder were mounted on the door, the related electronic components (for example the components 94, 96, 100 to the extent employed) could be provided in the door mounted circuit to reduce the number of electrical conductors between the door and header mounted circuits. In that regard, the door and header mounted circuits are electrically connected via a generally U-shaped flexible cable 103 having one end fixed to the door 12 adjacent and parallel to the door pivot axis and its other end parallel to the door pivot axis and fixed to the doorjamb 39. In the shown embodiment, the electrical cable 103 has six electrical conductors, two conductors for connecting the header mounted converter 100 to the door mounted converter 102, two conductors for supplying power to the door mounted circuit, and two conductors for connecting the door mounted circuit to the header mounted motor control circuit 20. The electronic circuit of the traffic responsive control system 10 is divided into header and door mounted circuits to minimize the number of conductors in the flexible cable 103.

The memory 84 provides an eight bit control signal (stored in 256×32 page memory locations of the memory 84) for each of a maximum of thirty-two transmitters (selected by the five bit transmitter select input from the counter 74) at each of 256 incremental positions of the door (selected by the eight bit door position input from the converter 102). Thus, the memory 84 is programmed to establish a separate eight bit control signal for each transmitter 34 at each of 256 incremental door positions. Although the memory 84 is preferably programmed to provide a standard control signal format, described hereinafter, useful for most installations; if desired, the memory can be custom programmed in accordance with the particular requirements of a door installation.

Each eight bit control signal provided by the memory 84 comprises a four bit power level control segment for selecting one of sixteen available power levels in the range of 2.2 volts to 10 volts for operating the corresponding LED emitter 34. For that purpose, the four bit output for the power level control segment is connected via a binary to analog converter 104 and a master transmitter range control circuit 105 to a voltage divider 106 for setting the emitter drive voltage. A single bit output for a power off control segment is connected via an OR gate 108 to an emitter switch 110 for selectively deactivating the corresponding emitter 34. Also, the pulse shaper 80 is connected via the OR gate 108 to the emitter switch 110 for pulsing each LED emitter 34 for only approximately fifteen microseconds and at a 7500 Hz frequency modulated by the pulse position modulator 72. Of the remaining three bit output of the microprocessor 84, one bit is not employed in the described embodiment and the remaining two bit segment is used to operate a sensor selector or multiplexor 114 to (a) selectively connect the sensor receiver systems to a receiver pulse accumulator 116 and (b) selectively connect the output of the pulse accumulator 116 to operate the sensor indicators 38 and to generator "Safety" and "Operate" signals. The sensor selector 114 is thereby operated in synchronism with the sensor emitters (a) so that each receiver system is activated (i.e. connected to the accumulator 116) only while a corresponding LED emitter 34 is selected, except that the receiver systems of the LES sensor 30 and rail sensor 32 are connected to be activated together while an emitter 34 of either of those sensors is selected, and (b) to connect the output of the pulse accumulator 116 to energize the corresponding indicator 38 and generate the appropriate "Safety" or "Operate" signal.

The twenty-nine emitters 34 of the control system for example are operated at the power levels and selectively deactivated as shown in the following table which sets forth the selected power level and selected state of each of the twenty-nine LED emitters 34 at each of ten operating sectors of the swinging door 12:

| Door Sector | | 1st | 2nd | 3rd | 4th | 5th | 6th | 7th | 8th | 9th | 10th |
|---|---|---|---|---|---|---|---|---|---|---|---|
| Count | | 0 | 6 | 31 | 61 | 91 | 121 | 151 | 181 | 211 | 241 |
| Range | | 5 | 30 | 60 | 90 | 120 | 150 | 180 | 210 | 240 | 255 |
| Sector | | 0 | 1.81 | 10.9 | 21.5 | 32.0 | 42.5 | 53.1 | 63.6 | 74.2 | 84.7 |
| Angle | | 1.76 | 10.5 | 21.1 | 31.7 | 42.2 | 52.7 | 63.3 | 73.8 | 84.4 | 89.7 |
| LES SENSOR | 1 | 3 | 3 | 3 | 1 | 1 | 1 | 1 | 1 | off | off |
| | 2 | 3 | 3 | 3 | 1 | 1 | 1 | 1 | 1 | off | off |
| | 3 | 3 | 3 | 1 | 1 | 1 | 1 | 1 | 1 | off | off |
| | 4 | 5 | 3 | 1 | 1 | 1 | 1 | 1 | 1 | off | off |
| | 5 | 5 | 3 | 1 | 1 | 1 | 1 | 1 | 1 | off | off |
| | 6 | off | off | off | 1 | 1 | 1 | 1 | off | off | off |
| | 7 | off | off | off | off | 1 | 1 | 1 | 1 | 1 | off |
| PS SENSOR | 1 | 3 | 3 | 3 | 3 | 3 | 3 | 3 | 3 | off | off |
| | 2 | 3 | 3 | 3 | 3 | 3 | off | off | off | off | off |
| | 3 | 3 | 3 | 3 | off | off | off | off | off | off | off |
| | 4 | 5 | 3 | off | off | off | off | off | off | off | off |
| | 5 | 5 | off | off | off | off | off | off | off | off | off |
| | 6 | off | off | off | off | off | off | off | off | off | off |
| | 7 | off | off | off | off | off | off | off | off | off | off |
| RS SENSOR | 1 | 3 | off | off | off | off | off | off | off | off | off |
| LEO SENSOR | 1 | 3 | 3 | 3 | 3 | 3 | 3 | 3 | 3 | 3 | 3 |
| | 2 | 3 | 3 | 3 | 3 | 3 | 3 | 3 | 3 | 3 | 3 |
| | 3 | 5 | 5 | 5 | 3 | 9 | 3 | 3 | 3 | 3 | 3 |
| | 4 | 5 | 5 | 3 | 3 | 3 | 3 | 3 | 3 | 3 | 3 |
| | 5 | 5 | off | off | off | 3 | 3 | 3 | 3 | 3 | 3 |
| | 6 | off | off | off | off | off | 3 | 3 | 3 | 3 | 3 |
| | 7 | off | off | off | off | off | off | 9 | 9 | 9 | 9 |
| PO SENSOR | 1 | 5 | 1 | 1 | 1 | 1 | 1 | 3 | 3 | 3 | 3 |
| | 2 | 5 | 1 | 1 | 1 | 1 | 1 | 1 | 4 | 4 | 4 |
| | 3 | 5 | 2 | 2 | 2 | 2 | 2 | 2 | 2 | 2 | 2 |
| | 4 | 7 | 2 | 2 | 2 | 2 | 2 | 2 | 2 | 2 | 2 |
| | 5 | 7 | 2 | 2 | 2 | 2 | 2 | 2 | 2 | 2 | 2 |
| | 6 | off | off | off | off | off | off | 4 | 4 | 4 | 4 |
| | 7 | off | off | off | off | off | off | 3 | 3 | 3 | 3 |

In the above table, the first two rows give the start and ending decimal counts (provided by the eight bit input to the memory 84) for each of the ten selected door sectors. The corresponding beginning and ending sector are given in the second two rows. For the purpose of calculating the angular position of the door, each door position count is considered to be equal to a constant angular increment of movement of the door of 0.3515625 degrees (i.e. 90 degrees divided by 256). The power level and status of each LED emitter 34 is given for each door sector in the remaining twenty-nine rows. As previously indicated, any one of sixteen emitter drive voltage levels may be selected, in the range from 2.2 volts to 10 volts (as modified by the emitter range control 105) in approximately equal increments. In the above table the selected voltage level is indicated by an alphanumeric code of 0, 1, 2, . . . 9, A, B, C, D, E, F with "O" representing the lowest drive voltage (i.e., 2.2 volts as modified) and "F" representing the highest drive voltage (i.e., 10 volts as modified). The "off" state is designated where the LED emitter is inactivated via the switch 110 (and in that case the power level control segment selects the lowest or 2.2 drive voltage).

In accordance with the above table, the rail sensor 32 is operated only when the door is in its first sector when the door is closed. With regard to the LES sensor, the set of five inwardly facing emitters 1–5 are operated at relatively higher power levels in the first door sector and at relatively lower power levels as the door is opened and are inactive or off in the last two door sectors. The two outwardly facing emitters 6 and 7 are inactive or off except during four and five intermediate sectors of the door when the beam axes of those emitters are generally aligned with the doorway path. With regard to the PS sensor, the set of five inwardly facing emitters 1–5 are active when the door is closed and are progressively deactivated to avoid sensing any adjacent wall or other object or traffic at the side of the traffic path of travel behind the door. The two outwardly facing emitters 6 and 7 of the PS sensor remain off or inactive in all ten sectors of the door to avoid sensing any traffic, etc. adjacent to but outside the desired coverage zone of the sensor system.

With regard to the LEO sensor, the set of five inwardly facing emitters 1–5 are active in the closed sector of the door and remain active throughout the full range of pivotal movement of the door except that emitter 5 is inactive or off in the second, third and fourth sectors to avoid sensing the adjacent doorjamb 40 as the door opens. The two outwardly facing emitters 6 and 7 are inactive or off in the first five or six sectors and are active for the remaining sectors to provide coverage on the exit path extending from the partly or fully opened door.

With regard to the PO sensor, the set of five inwardly facing emitters 1–5 are operated at the 5 and 7 voltage drive levels with the door in its closed sector to sense approaching traffic. Thereafter, those emitters are operated at somewhat lower drive voltage levels, primarily to protect against abrupt engagement of the door with doorway traffic as the door closes. The two outwardly facing emitters 6 and 7 are inactive or off during the first six door sectors and are operated during the last four door sectors to provide for sensing approaching traffic for holding the door open.

All of the emitters 34 are either inactivated or operated at low voltage levels to avoid sensing the doorjambs 39, 40, the exit guard rails 68 and any pedestrian traffic, structure or other object adjacent to but at the side of the desired coverage areas on the entrance and exit sides of the doorway opening. As previously indicated, each emitter can be selectively controlled by the memory 84 to provide the desired coverage while at the same time avoiding sensing any pedestrian or object adjacent to but outside the desired coverage area. Also it can be seen that the coverage area can be custom designed for each installation in accordance with the physical limitations of the installation.

Referring to FIGS. 10B and 11, the three photodiode receivers 36 of each of the four primary sensors 28–31 are connected in parallel to a corresponding amplifier 118 to amplify the receiver signal. Likewise, the rail sensor 32 has an amplifier 118 for its single diode receiver 36 to amplify the received signal. When the amplified signal reaches a predetermine threshold level, a pulse is transmitted to the pulse accumulator 116 via the selector 114. The accumulator 116 has two pulse counters 120, 122 which are clocked by the emitter timing pulse from the pulse shaper 80 to filter out all receiver signals not generated during the interval of emitter operation. Also, the selector 114 will filter out an receiver signals generated by an inactive sensor.

In the accumulator 116, the receiver pulse counter 120 is indexed by each receiver pulse transmitted via the selector 114 and the transmitter pulse counter 122 is indexed by each transmitter timing pulse. Accordingly, the transmitter pulse counter 122 is indexed to count the maximum number of transmitter pulses which may be received by the active receivers 36. The transmitter pulse counter 122 resets itself and also the receiver pulse counter 120 at the end of each cycle of ten transmitter pulses. If during that ten count cycle at least eight of the transmitted pulses have been received by the active receivers 36 (as determined by the receiver pulse counter 120 being indexed to a count of eight), a presence signal will be generated by the receiver pulse counter 120. Thus, for each transmitter 34, during each cycle of ten transmitter pulses, at least eight of the transmitter pulses must be reflected back to the active receivers 36 to generate a presence signal (which represents that door traffic or other object is sensed by the sensor). Accordingly, and also since the transmitter timing signals generated by the pulse shaper 80 are encoded by the modulator 72 as previously described, it is very unlikely that a presence signal will be generated by the sun or other external source of ambient radiant energy.

The pulse accumulator 116 is connected via the selector 114 and via a suitable pulse shaper circuit 124 and a suitable driver circuit 126 to operate the active indicator light 38 to indicate when traffic, etc. is sensed within the active coverage zone. Therefore, the indicator lights 38 are useful in determining the proper operation of each sensor 28–32 when installing and positioning the sensor, masking as desired a part of the sensor filters 46, 48 to narrow the sensor coverage area, and fine tuning each sensor by adjusting the receiver signal gain to adjust the sensor coverage zone. For that purpose, each sensor amplifier 118 has a gain control circuit 119 to adjust the sensor range and thereby fine tune the range and coverage zone of the sensor. In addition, the master range control circuit 105 provides for fine tuning the collective range and coverage zone of all five sensors. On installation, each individual amplifier gain control 119 and the master control 105 are adjusted to fine tune the system for the particular installation.

The two "Safety" outputs from the selector 114 for the three safety sensors 28,29,32 are connected via an OR gate and the circuits 124,126 to generate a "Safety" signal for operating the motor control circuit 20. Similarly, the two "Operate" outputs from the selector 114 for the two operate sensors 30,31 are connected via an OR gate and the circuits 124,126 to generate an "Operate" signal for operating the motor control circuit 20. As previously described, the "Safety" and "Operate"

signals control the opening and closing movement of the swinging door 12. The pulse shaper circuit 124, with respect to the indicator lights 38, provides for increasing the signal width to approximately one-tenth second to maintain the LED indicator lights energized between presence signal pulses. The pulse shaper circuit 124, with respect to the "Safety" and "Operate" signals, provides for increasing the signal width to approximately one-half second to provide smooth door control.

It is contemplated that the described safety sensor subsystem (which includes three safety sensors 28,29,32 as described or just the two primary safety sensors 28,29) could be employed with an entrance sensor subsystem which is different than that described. For example, the entrance sensor system could be provided by a commercially available microwave motion sensor mounted above the door for sensing motion in the entrance area to the swinging door. Also, it will be apparent to persons skilled in the art, that other modifications, adaptations and variations of the foregoing specific disclosure can be made without departing from the teachings of the present invention.

We claim:

1. In an automatic door installation having a swinging door, a power operator for swinging the door between a closed position thereof closing a doorway opening and an open position thereof on a swing side of the doorway opening, and a traffic responsive control system comprising radiant energy emitter and receiver means for sensing doorway traffic along a traffic path of travel through the doorway opening, and door control means operated by the traffic sensing means to automatically open the door for traffic to pass along said traffic path of travel, the improvement wherein the traffic sensing means comprises at least one multiple emitter sensor mounted on the door having a bank of a plurality of radiant energy emitters with radiant energy beams having axes angularly spaced along the said traffic path of travel and collectively providing an effective emitted energy coverage area intersecting the said traffic path of travel and radiant energy receiver means adjacent the bank of emitters for receiving reflected radiant energy emitted from the bank of emitters, the said one multiple emitter sensor being a swing side sensor mounted on the door on the swing side thereof adjacent one side edge of the door to provide a said effective coverage area on the swing side of the door which intersects the traffic path of travel when the door is in its said closed position, and wherein the traffic responsive control system further comprises door position responsive means for selectively operating the emitters of the said swing side sensor by selectively activating those emitters at a plurality of different radiant energy levels and deactivating those emitters to vary the said effective coverage area as the door is swung between its said closed and open positions.

2. An automatic door installation according to claim 1 wherein the traffic sensing means comprises another said multiple emitter sensor mounted on the swing side of the door adjacent the other side edge of the door from said one sensor and providing a second swing side sensor with a said coverage area on the swing side of the door which intersects the said traffic path of travel when the door is in its said closed position, and wherein the door position responsive means selectively operates the emitters of the said second swing side sensor by selectively activating those emitters at a plurality of different radiant energy levels and deactivating those emitters to vary the said effective coverage area as the door is swung between its said closed and open positions.

3. An automatic door installation according to claim 1 wherein the swing side sensor is mounted on the door adjacent the free side edge thereof and wherein the door position responsive means activates certain emitters of the swing side sensor in the said closed position of the door and activates certain other emitters of that sensor as the door is swung from its said closed to its said open position.

4. An automatic door installation according to claim 1 wherein the swing side sensor is mounted on the door adjacent the pivot edge of the door and wherein the door position responsive means activates certain emitters of the swing side sensor in the said closed position of the door and selectively deactivates those emitters as the door is swung from its said closed position to its said open position.

5. An automatic door installation according to claim 1 wherein the traffic sensing means comprises another said multiple emitter sensor mounted on the non-swing side of the door adjacent one side edge of the door and providing a non-swing side sensor with a said coverage area intersecting the said traffic path of travel on the non-swing side of the door when the door is in its said closed position.

6. An automatic door installation according to claim 1 wherein the traffic sensing means further comprises a free edge sensor mounted on the swing side of the door adjacent the free side edge of the door and having at least one emitter for emitting a radiant energy beam which extends generally normal to the plane of the door at the free side edge thereof and radiant energy receiver means mounted adjacent the said one emitter for receiving reflected radiant energy emitted from each emitter of the said free edge sensor.

7. An automatic door installation according to claim 1 wherein the traffic sensing means comprises another said multiple emitter sensor mounted on the swing side of the door adjacent the other side edge of the door from the said one multiple emitter sensor and providing a second swing side sensor with a said effective coverage area on the swing side of the door which intersects the said traffic path of travel when the door is in its said closed position, another said multiple emitter sensor mounted on the non-swing side of the door and providing a non-swing side sensor with a said effective coverage area which intersects the said traffic path of travel on the non-swing side of the door when the door is in its said closed position, and wherein the door position responsive means selectively operates the emitters of the said second swing side sensor and the said non-swing side sensor by selectively activating those emitters at a plurality of different radiant energy levels and deactivating those emitters to vary their said effective coverage areas as the door is swung between its said closed and open positions.

8. An automatic door installation according to claim 1 wherein the traffic responsive means comprises another said multiple emitter sensor mounted on the swing side of the door adjacent the other side edge of the door from the said one multiple emitter sensor and providing a second swing side sensor with a said effective coverage area on the swing side of the door which intersects the said traffic path of travel when the door is in its said closed position, another said multiple emitter sensor mounted on the non-swing side of the door adjacent one ae edge of the door and providing a non-swing side ensor with a said effective coverage area which intersects the said traffic path of travel on the non-swing side of the door when the door in in its said closed position, and a free edge sensor mounted on the swing side of the door adjacent the free side edge thereof and having at least one emitter for emitting a radiant energy beam which extends generally normal to the door and radiant energy receiver means mounted adjacent the said one emitter for receiving reflected radiant energy emitted from each emitter of the said free edge sensor, and wherein the door position responsive means selectively operates the emitters of the said second swing side sensor, the said non-swing side sensor and the said free edge sensor by selectively activating those emitters at a plurality of different radiant energy levels and deactivating those emitters to vary their said effective coverage areas as the door is swung between its closed and open positions.

9. In an automatic door installation having a swinging door, a power operator for swinging the door between a closed position thereof closing a doorway opening and an open position thereof on a swing side of the doorway opening, and a traffic responsive control system comprising radiant energy emitter and receiver means for sensing doorway traffic along a traffic path of travel through the doorway opening, and door control means operated by the traffic sensing means to automatically open the door for traffic to pass along said traffic path of travel, the improvement wherein the traffic sensing means comprises at least one multiple emitter sensor mounted on each side of the door, each having a bank of a plurality of radiant energy emitters with radiant energy beams having axes angularly spaced along the said traffic path of travel and collectively providing an effective emitted energy coverage area intersecting the said traffic path of travel and radiant energy receiver means adjacent the bank of emitters for receiving reflected radiant energy emitted from the bank of emitters, the said one sensor on each side of the door being mounted adjacent one side edge of the door to provide a said effective coverage area on the respective side of the door which intersects the traffic path of travel when the door is in its said closed position, and wherein the traffic responsive control system further comprises door position responsive means for selectively operating the emitters of each said one sensor by selectively activating those emitters at a plurality of different radiant energy levels and deactivating those emitters to vary the respective effective coverage area as the door is swung between its said closed and open positions.

10. In an automatic door installation having a swinging door, a power operator for swinging the door between a closed position thereof closing a doorway opening and an open position thereof on a swing side of the doorway opening, and a traffic responsive control system comprising radiant energy emitter and receiver means for sensing doorway traffic along a traffic path of travel through the doorway opening, and door control means operated by the traffic sensing means to automatically open the door for traffic to pass along said traffic path of travel, the improvement wherein the traffic sensing means comprises at least one multiple emitter sensor mounted on the door having a bank of a plurality of radiant energy emitters with radiant energy beams having axes angularly spaced along the said traffic path of travel and collectively providing an effective emitted energy coverage area intersecting the said traffic path of travel and radiant energy receiver means adjacent the bank of emitters for receiving reflected radiant energy emitted from the bank of emitters, the said one multiple emitter sensor being mounted on the door on said one side of the door which intersects the traffic path of travel when the door is in its said closed position, and wherein the traffic responsive control system further comprises door position responsive means for selectively operating the emitters by selectively activating those emitters at a plurality of different radiant energy levels and deactivating those emitters to vary the said effective coverage area as the door is swung between its said closed and open positions.

11. An automatic door installation according to any one of claims 1, 2, 9, or 10 wherein the door position responsive means comprises sensor control means operable at each of a plurality of different angular positions of the swinging door between its closed and open positions for generating emitter control signals at each of said plurality of different angular positions respectively for controlling the said operation of the emitters.

12. An automatic door installation according to any one of claims 1, 2, 9 or 10 wherein the traffic sensing means comprises sensor operating means for individually pulsing the emitters of all of said sensors in a predetermined sequence.

13. An automatic door installation according to any one of claims 1, 2, 9 or 10 wherein the traffic sensing means comprises sensor operating means for individually pulsing the emitters of all of said sensors in a predetermined sequence for emitting radiant energy pulses therewith in a predetermined sequence and for selectively activating the radiant energy receiver means of each said sensor to receive reflected radiant energy pulses from each emitter of the respective sensor.

14. An automatic door installation according to any one of claims 1, 2, 9 or 10 wherein the traffic sensing means comprises sensor operating means for individually pulsing the emitters for emitting radiant energy pulses and presence signal generating means for each sensor for separately accumulating the number of emitted radiant energy pulses and the number of pulses received by the respective receiver means and for transmitting a presence signal for operating the door control means when there is a predetermined accumulated number of received pulses during a predetermined number of emitted pulses.

15. An automatic door installation according to claim 1 or 2 wherein the bank of emitters comprises a set of a plurality of said emitters mounted for emitting radiant energy emission beams having axes with a substantially constant angular spacing.

16. An automatic door installation according to claim 15 wherein said substantially constant angular spacing is approximately 15 degrees.

17. An automatic door installation according to any one of claims 1, 2, 9 or 10 wherein each sensor has a first set of a plurality of five inwardly facing radiant energy emitters and a second set of at least two outwardly facing radiant energy emitters.

18. An automatic door installation according to claim 5 or 8 wherein each said non-swing side sensor has a primary set of a plurality of five inwardly facing radiant energy emitters.

19. An automatic door installation according to claim 1, 9 or 10 wherein each emitter is an LED emitter and wherein the traffic sensing means comprises sensor operating means for regulating the emitter drive voltage of each emitter.

20. An automatic door installation according to claim 19 wherein the sensor operating means includes means for pulsing the emitters for emitting radiant energy pulses and pulse width control means to establish a predetermined short radiant energy pulse width.

21. An automatic door installation according to claim 1, 9 or 10 wherein the traffic sensing means comprises sensor operating means for pulsing the emitters individually in succession for emitting successive radiant energy pulses in accordance with a predetermined encoded pulse spacing.

22. An automatic door installation according to claim 21 wherein the sensor operating means comprises a constant frequency pulse source and a pulse position modulator settable for establishing said predetermined encoded pulse spacing.

23. An automatic door installation according to any one of claims 1, 2, 9 or 10 wherein the traffic sensing means comprises sensor operating means for individually and sequentially pulsing the emitters in pulse bursts for sequentially emitting a radiant energy pulst with each emitter, receiver select means for selectively activating the receiver means when a respective emitter is being pulsed, and a single presence signal generating means for all of the receiver means for transmitting a presence signal for operating the door control means when a predetermined number of pulses are received by the receiver means during a predetermined number of emitted pulses.

24. An automatic door installation according to claim 23 wherein the traffic sensing means comprises indicator means for indicating when a presence signal is generated by a sensor.

25. An automatic door installation according to any one of claims 1, 9, or 10 wherein each emitter is an LED emitter and wherein each said multiple emitter sensor comprises emitter support means adapted to be mounted on the door and having a plurality of LED emitter support bores therein for the plurality LED emitters respectively, the LED emitter support bores having angularly spaced axes corresponding to said angularly spaced axes of the radiant energy beams respectively and receiving the LED emitters to align the axes of the radiant energy emission beams from the LED emitters with the bore axes respectively.

26. A radiant energy emitter system, for use in an automatic door installation, according to claim 25, wherein the emitter support means comprises at least one emitter support block having a plurality of said LED emitter support bores.

* * * * *